United States Patent [19]

Gorham

[11] 4,160,519

[45] Jul. 10, 1979

[54] PAPERBOARD BULK BIN

[75] Inventor: Jack C. Gorham, Keokuk, Iowa

[73] Assignee: Champion International Corporation, Stamford, Conn.

[21] Appl. No.: 913,525

[22] Filed: Jun. 7, 1978

Related U.S. Application Data

[63] Continuation of Ser. No. 809,085, Jun. 23, 1977, abandoned.

[51] Int. Cl.[2] ..... B65D 5/02

[52] U.S. Cl. ..... 229/37 R; 229/23 R; 229/DIG. 3

[58] Field of Search ..... 229/37 R, 30, 37 E, 229/DIG. 3, 23 R

[56] References Cited

U.S. PATENT DOCUMENTS

| | | | |
|---|---|---|---|
| 1,158,130 | 10/1915 | Hawkins | 229/37 R |
| 1,808,833 | 6/1931 | Brack | 229/37 R |
| 2,745,617 | 5/1956 | Paige | 229/37 R |
| 3,817,444 | 6/1974 | Yoch | 229/DIG. 3 |

*Primary Examiner*—William Price
*Assistant Examiner*—Joseph Man-Fu Moy
*Attorney, Agent, or Firm*—Evelyn M. Sommer

[57] ABSTRACT

A paperboard bulk pin having a plurality of planar side walls and a bottom closure in which each side wall includes an integrally formed, inwardly projecting, laterally extending rib to reduce side wall bulging.

1 Claim, 8 Drawing Figures

PAPERBOARD BULK BIN

This is a continuation of application Ser. No. 809,085, filed June 23, 1977, now abandoned.

BACKGROUND OF THE INVENTION

This invention relates to bulk bins. More particularly, this invention relates to bulk bins made of paperboard or similar material.

Bulk bins made of paperboard or similar material are well known in the art and widely used to hold quantities of many different types of bulk materials. One of the problems with paperboard bulk bins is that the side walls have a tendency to bulge when the bin is filled to capacity or near capacity. One known way that is often employed to reduce side wall bulging is to insert some type of supporting member inside the bin to reinforce the side walls. Such supporting members have proven to be fairly complicated in structure and have consumed significant amounts of paperboard in their construction. Another known way that is often used to reduce side wall bulging is to connect opposing side walls of the bin with some type of bridge or strut. It has been found that these bridges or struts are complicated in structure, require significant amounts of paperboard and interfere with the use of the bin as a container for holding materials. Furthermore such bridges or struts are limited to bins having an even number of side walls. In any event, for one reason or another, neither of these arrangements has proven to be entirely satisfactory from a functional or structural standpoint. Examples of bulk bins constructed from paperboard may be found in U.S. Pat. Nos. 1,904,365; 2,091,201; 3,000,496; 3,526,352; and 3,945,558 and examples of containers which utilize a bridge or strut connected to opposing side walls to reduce side wall bulging may be found in U.S. Pat. Nos. 3,047,204; 3,197,113; and 3,946,935.

SUMMARY OF THE INVENTION

It is an object of this invention to provide a new and improved bulk bin.

It is another object of this invention to provide a paperboard bulk bin in which side well buldging is reduced to a minimum.

It is still another object of this invention to provide a paperboard bulk bin which includes a new and improved integrally formed means for reducing side wall bulging.

It is yet still another object of this invention to provide a paperboard bulk bin in which side wall bulging is reduced without the use of bridges or struts connected between opposing side walls or separately formed supporting structures which are placed inside the bin.

It is another object of this invention to provide a way of reducing side wall bulging in a paperboard bulk bin which can be applied to bins having any number of sidewalls.

It is yet still another object of this invention to provide a paperboard bulk bin having means for reducing side wall bulging which is economical in cost and easy to assemble.

This invention is based on the concept of integrally forming on each one of the side walls of a paperboard bulk bin a laterally extending, inwardly projecting, rib. The ribs on the respective side walls are positioned in alignment with one another and extend from one side of their respective side wall to the other so as to form a continuous rib extending laterally around the inside of the bin. The ribs are made by scoring each one of the side walls with a group of four horizontal, parallel fold lines, with the two outer fold lines being normally folded and the two inner fold lines being reverse scored. The ribs are brought into shape by causing the area between the two outermost score lines in the group to break inward. According to another feature of the invention each side wall is provided with special corner cut out sections where the ribs meet the edges of the side walls so that the ribs will effectively lock in place with one another when the ribs are formed and the side walls and bottom cover flaps folded into place to form a bin. The bin may be further strengthened against side wall bulging by reinforcing the ribs with banding material. The bin may be still further strengthened by applying strips of tape around the outside of the side walls.

The foregoing and other features and advantages of the invention will appear from the description to follow. In the description, reference is made to the accompanying drawings which form a part thereof, and in which is shown by way of illustration, two specific embodiments for practicing the invention. These embodiments will be described in sufficient detail to enable those skilled in the art to practice the invention, and it is to be understood that other embodiments may be made without departing from the scope of the invention. The following detailed description is, therefore, not to be taken in a limiting sense, and the scope of the invention is best defined by the appended claims.

BRIEF DESCRIPTION OF THE DRAWINGS

In the drawings wherein like reference numerals represent like parts.

DETAILED DESCRIPTION OF PREFERRED EMBODIMENT

Figure 1:
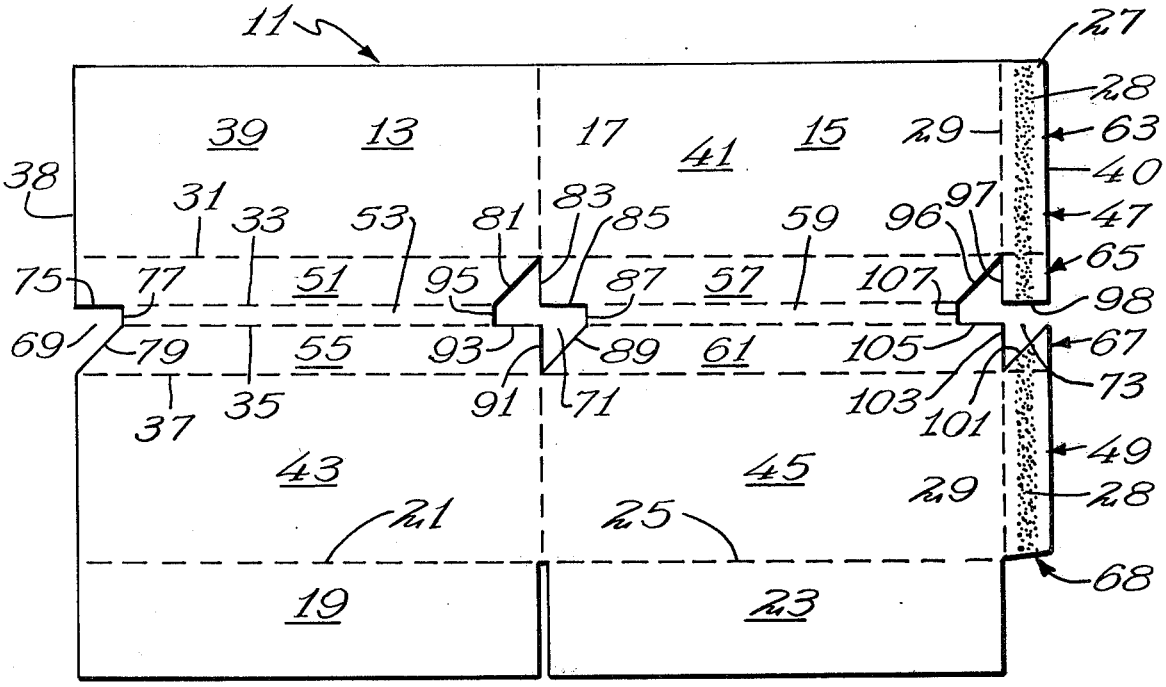
FIG. 1 is a plan view of a paperboard blank constructed according to this invention, which, when erected will form one half of a bulk bin.
Figure 2:
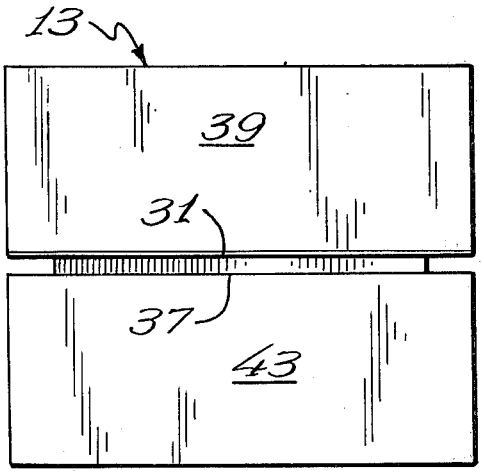
FIG. 2 is a plan view of one of the side walls of the blank shown in FIG. 1, with the rib section folded into the assembled position.
Figure 3:
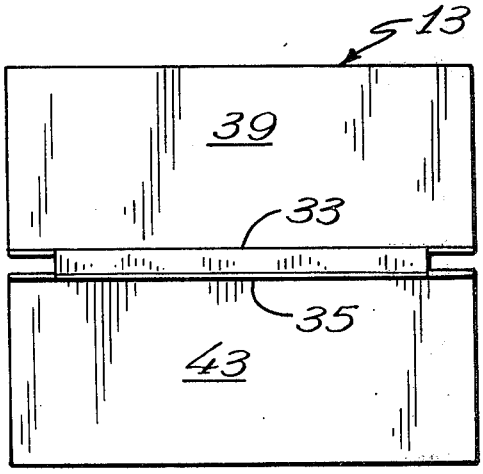
FIG. 3 is a plan view of the side wall shown in FIG. 2 taken from the reverse side.
Figure 4:
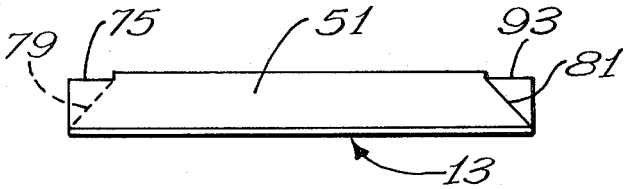
FIG. 4 is a top view of the side wall shown in FIG. 2.
Figure 5:
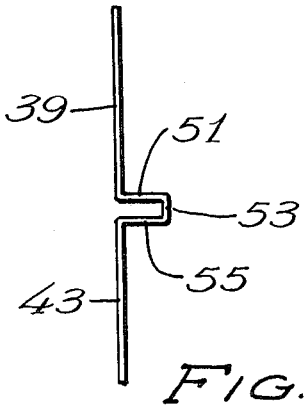
FIG. 5 is a side elevation view of the side wall shown in FIG. 2.

Referring now to the drawings, and in particular to FIGS. 1 through 5, there is shown in FIG. 1 a unitary blank made of paperboard or corrugated board or the similar material and identified generally by reference numeral 11.

The blank 11 includes a pair of rectangular side wall panels 13 and 15 hingedly connected to each other in side-by-side relationships by a vertical fold line 17 which defines the right edge of side wall panel 13 and the left edge of side wall panel 15. A rectangular bottom cover flap 19 is hingedly connected to side wall panel 13 by a fold line 21 which defines the lower edge of side wall panel 13 and a rectangular bottom cover flap 23 is hingedly connected to side wall panel 15 by a fold line 25 which defines the lower edge of side wall panel 15. A generally rectangular glue flap identified by reference numeral 27 and containing a quantity of glue 28 is hingedly connected to side wall panel 15 by a fold line 29 which defines the outer side edge of side wall panel 15.

The blank 11 further includes a group of four horizontal parallel score lines 31, 33, 35, and 37 which extend from the outer edge 38 of side wall panel 13 to the outer edge 40 of glue flap 27 and are parallel to the upper and lower edges of side wall panels 13 and 15. Score lines 31 through 37 divide side wall panels 13 and 15 into upper side wall sections 39 and 41 respectively and lower side wall sections 43 and 45 respectively. Score lines 31 through 37 also divide the glue flap 27 into an upper section 47 and a lower section 49. Score lines 31 and 37 are scored normally where as score lines 33 and 35 are reverse scored and divide the areas between the two outermost score lines 31 and 37 into intermediate sections 51, 53 and 55 on side wall panel 13, intermediate sections 57, 59 and 61 on side wall panel 15 and intermediate sections 63, 65, 67 and 68 on glue flap 27. When the blank 11 is properly folded, the area between score lines 31 and 37, on each side wall panel 13 and 15 collapses inward to form an inwardly projecting rib the area between the score lines 31 and 37 on glue flap 27 also folds in. The blank 11 further includes three specially shaped corner cutouts 69, 71 and 73 where the area between horizontal score lines passes through the vertical fold lines and the left outer edge of the blank so that when the blank is erected the ribs will effectively interlock with each other. As can be seen, corner cutout 69 is in the shape of a trapezoid defined by edges 75, 77 and 79 whereas cutouts 71 and 73 are in the form of two trapezoids definally edges 81 through 95 and 96 through 107.

Figure 6:
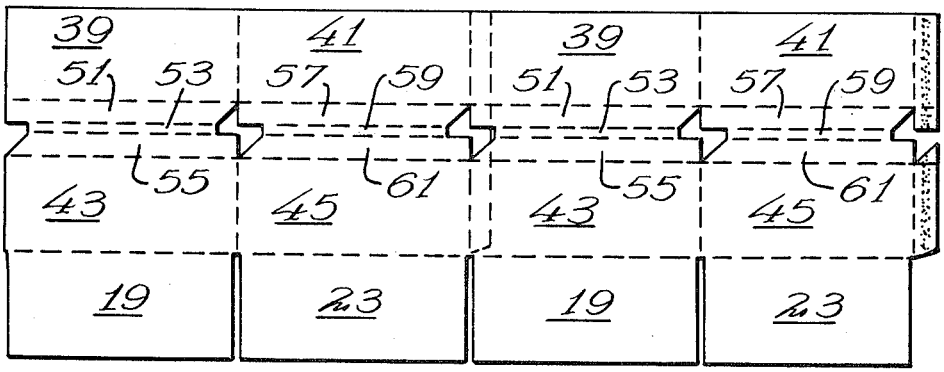
FIG. 6 is a plan view of two of the paperboard blanks shown in FIG. 1 connected in side-by-side relationship, adapted to be erected into a bulk bin according to this invention; and reduced in size for convenience.
Figure 7:
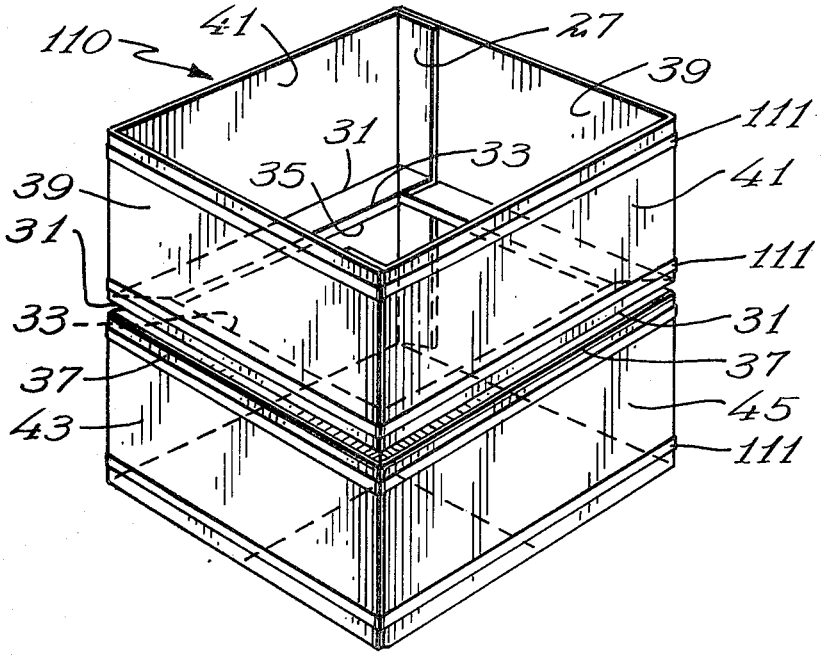
FIG. 7 is a perspective view of an assembled bulk bin constructed according to this invention.

A bulk bin 110 constructed according to this invention is assembled by first taking two blanks of the type shown in FIG. 1 and connecting them together in side-by-side relationship as shown in FIG. 6. The fully assembled bulk bin 110 with the two outer edges joined together; the strengthening of rib formed in phase and the bottom flaps interconnected to form a bottom closure is shown in FIG. 6. The bulk bin 110 may be further strengthened by applying four strips of an adhesive tape 111 laterally around the outside of the bin, one strip around the side wall near the top, another strip around the side walls near the bottom, a strip just above the rib forming area and a strip just below the rib forming area. The bulk bin 110 may still be further strengthened by applying a strip of banding material 112 around the side walls in between score lines 33 and 35. If banding material is applied between score lines 33 and 35, a strip of adhesive tape (not shown) should first be applied at this area so that the banding material will not tear or cut into the blank material.

Figure 8:
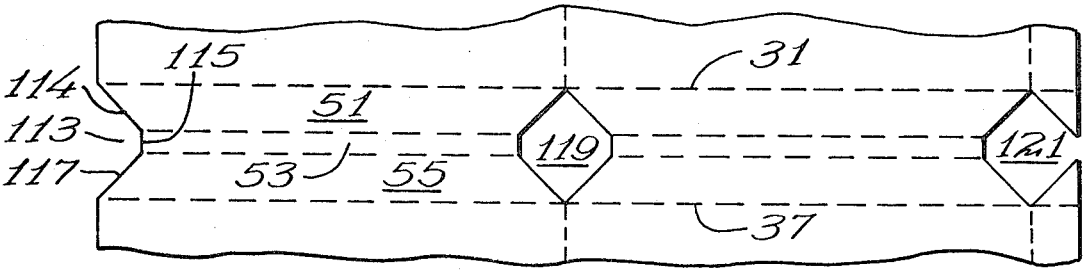
FIG. 8 is a plan view rib of a modified form of the rib forming section of the blank shown in FIG. 1.

In FIG. 8 there is shown a modified version of the corner cut out sections at the ends of the ribs. As can be seen corner cut out section 113 is in the shape of one half of a diamond and defined by edges 114, 115 and 117 and corner cut outs 119 and 121 are diamond shaped with all three cutouts having squared off corners. If a bulk bin is constructed using two blanks having corner cutouts shaped as shown in FIG. 8, banding material should be used around the rib to insure that the corner will lock properly in place.

It will be understood that various changes in the details, materials and arrangement of parts which have been herein described and illustrated in order to explain the nature of the invention may be made by those skilled in the art within the principles and scope of the invention.

For example the hereinbefore described four walled bulk bin may be formed from a single blank die cut to have four side wall panels and associated bottom cover flaps instead of two die cut blanks each having only two side walls and associated cover flaps.

What is claimed is:

1. A paperboard blank for use in the construction of a bulk bin and having opposed first and second surfaces said blank comprising:

first and second rectangular side wall panels hingedly connected to each other in side-by-side relationship by a vertical fold line defining the inner edge of each side wall panel;

a glue flap hingedly connected to the outer side edge of said second side wall panel; and a cover flap hingedly connected to the bottom edge of each side wall panel, each of said side walls having four, parallel, horizontal fold lines, the two outermost fold lines being scored into said first blank surface, and the two innermost fold lines being scored into said second blank surface, thus subdividing each of said side walls into a top portion, a bottom portion, and three intermediate portions, said outermost horizontal fold lines extending across the width of said glue flap, said side walls further including a first cutout disposed on the outer lateral edge of said first side wall panel, second and third cutouts disposed on the interior edges of said first and second side wall panels, said second and third cutouts being diagonally opposed to one another and partially overlapping one another, a fourth cutout disposed on the outer edge of said second side wall panel, and a fifth cutout partially extending across the entire width of the glue flap such that said glue flap comprises a top portion, a bottom portion and two spaced apart intermediate portions, said fifth cutout being diagonally opposed to and partially overlapping said fourth cutout such that when two of said blanks are connected side by side and folded to form the bin, said cutout portions cooperate with the three intermediate portions to form on each side wall an integrally locked inwardly protruding, substantially rectangular, horizontal rib portion such that one of said intermediate portion being substantially perpenticular to the other intermediate portions which are substantially parallel to each other, said rib portion reinforcing said wall to prevent bulging as said bin is filled to near capacity.

* * * * *